United States Patent [19]

Davis

[11] Patent Number: 4,703,540

[45] Date of Patent: Nov. 3, 1987

[54] WINDOW STAY

[76] Inventor: Ronald P. Davis, 77 Breaker Bay Rd., Wellington, New Zealand

[21] Appl. No.: 877,293

[22] Filed: Jun. 23, 1986

[30] Foreign Application Priority Data

Jun. 28, 1985 [NZ] New Zealand ..... 212598

[51] Int. Cl.[4] ..... F05D 1/108

[52] U.S. Cl. ..... 16/337; 16/342; 16/370; 49/250

[58] Field of Search ..... 16/337, 370, 342, 273, 16/DIG. 27; 49/248, 250, 251, 252; 403/162, 24, 108

[56] References Cited

U.S. PATENT DOCUMENTS

| | | | |
|---|---|---|---|
| 3,345,777 | 10/1967 | Anderberg et al. | 49/250 |
| 3,497,909 | 3/1970 | Davis | 16/342 |
| 4,441,835 | 4/1984 | Davis | 403/24 |
| 4,555,829 | 12/1985 | Davis | 16/342 |
| 4,582,435 | 4/1986 | Davis | 403/162 |

FOREIGN PATENT DOCUMENTS

| | | | |
|---|---|---|---|
| 2047309 | 11/1980 | United Kingdom | 49/251 |

*Primary Examiner*—Nicholas P. Godici
*Assistant Examiner*—Karen Skillman
*Attorney, Agent, or Firm*—McAulay, Fields, Fisher, Goldstein & Nissen

[57] ABSTRACT

A window stay for use in mounting a window sash to a window frame, comprising a lower arm adapted to be pivotally mounted to the frame of a window at its proximal end and to the sash of the window at its distal end, a first upper arm adapted to be pivotally mounted at its proximal end to the frame of the window at a point spaced from the mounting of the distal end of the said lower arm, a second upper arm pivotally connected at its proximal end to the distal end of the said first upper arm and adapted to be pivotally mounted at its distal end to the said window sash at a point spaced from the mounting of the distal end of the said lower arm, and an intermediate control arm extending between the said lower arm and the said first upper arm and pivotally connected to each at points spaced from the ends thereof so as to direct movement of said first upper arm during opening and closing the the stay.

20 Claims, 3 Drawing Figures

WINDOW STAY

Figures 1, 2:
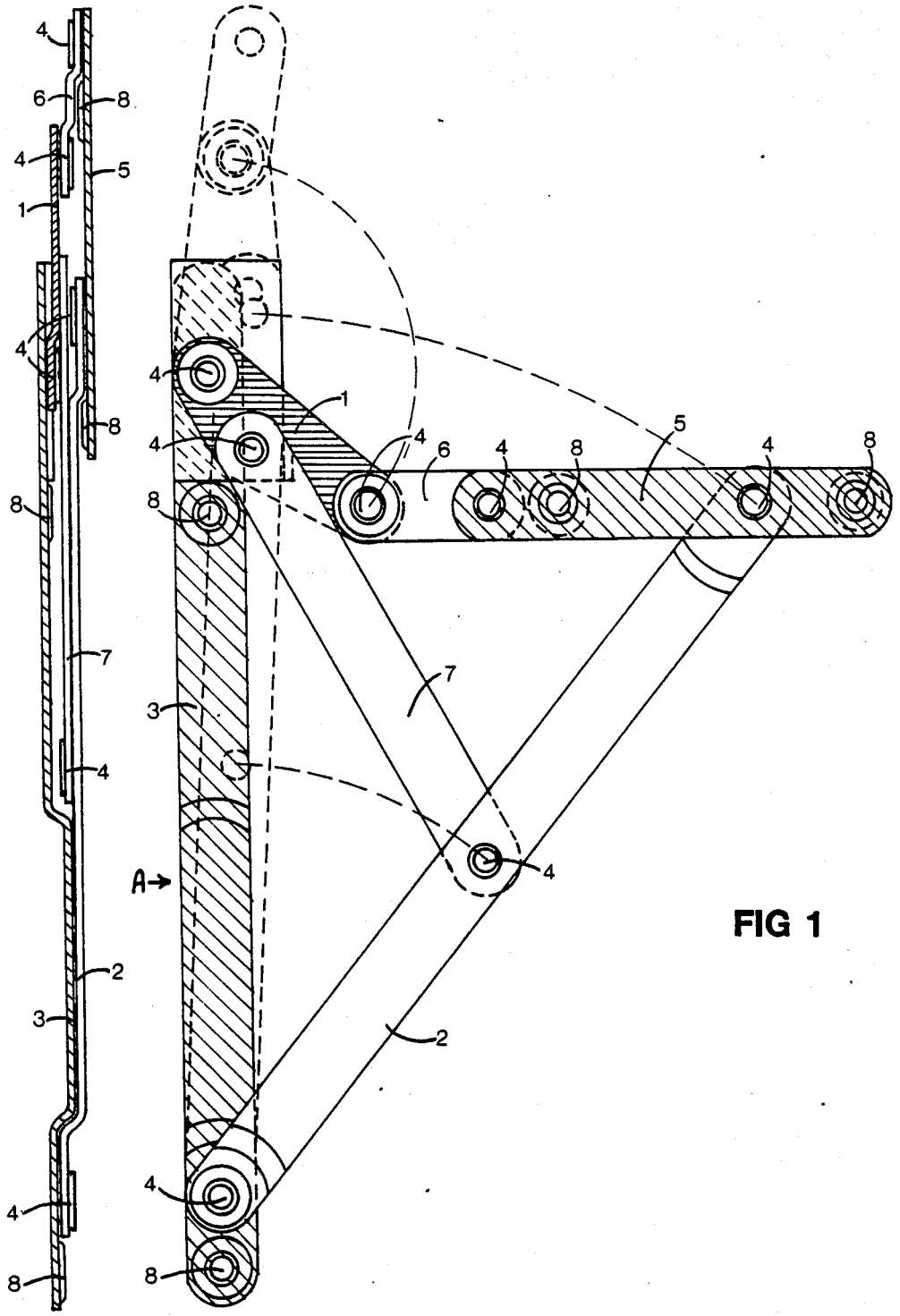

My present invention comprises a stay for a window or the like.

The four bar window stay the subject of New Zealand Pat. No. 144922/146130/146886 has over the last almost two decades proved particularly successful in its basic and subsequently refined forms, in many countries of the world. The success of the patent No. 144922/146130/146886 four bar stay has derived inter alia from its simplicity of construction, the stay comprising long life sealed in friction bearings and having no externally exposed and thus damage prone moving parts, and from the stays operation whereby a window sash is in use lifted out of the window aperture, enabling the provision of a peripheral sealing flange about the entire sash whilst still facilitating access for cleaning. This form of four-bar stay however provides only a relatively limited angle of opening and, in particular, it is not possible, from a practical point of view at least, to construct four-bar stays of this type which provide for ninety degrees or thereabouts of window opening, from a closed position to a position wherein the window extends perpendicularly to the frame.

Pantograph-type window stays which provide for such angles of opening are known, but these suffer from a number of disadvantages. They comprise externally moving parts and in particular at least one mechanically sliding pivot and track arrangement, and thus such stays are prone with time to clogging with grit, causing sticking of the mechanism, particularly at the fully open position, increased wear and tear, and so forth. The geometry of such stays is such that a strong negative pressure or 'pull in' is not provided at the top of the stay/window during closing, as is desired, and the additional top caps that are provided to assist in creating pull in are subject to bending and breakage. Such damage can result from, for example, jamming of a curtain in the window during closing. Additionally, pantograph-type stays do not generally provide for the removal of the top of the peripheral flange from the window early in the opening operation with such an action or movement as to avoid the tendency to dislodge or 'roll out' the sealing rubber or plastic weatherstrip that surrounds the window aperture. Further, pantograph-type stays as are available do not generally possess a high degree of inherent strength and are prone to flexing and bending particularly in a casement application for example. If the arms of the stay are formed of a size to overcome this and provide the required strength the stay will be too bulky to fit within a standard size window stay cavity.

It is not practically possible to construct four bar stays that provide for ninety or approaching ninety degrees of window opening. To do so it is necessary to place the sash mounting points of the arms of the stay so close together that the stay cannot properly support the window sash when it is opened. For stability it is important that the stay sash mounting points be spaced apart.

My present invention provides an improved or at least alternative form of window stay that provides for enlarged angles of window opening. The window stay of my invention possesses the significant advantages of the four-bar type stay referred to, while still providing for substantially ninety degrees of window opening.

In broad terms the invention may be stated to comprise a window stay for use in mounting a window sash to a window frame, comprising a lower arm adapted to be pivotally mounted to the frame of a window at its proximal end and to the sash of the window at its distal end, a first upper arm adapted to be pivotally mounted at its proximal end to the frame of the window at a point spaced from the mounting of the distal end of the said lower arm, a second upper arm pivotally connected at its proximal end to the distal end of the said first upper arm and adapted to be pivotally mounted at its distal end to the said window sash at a point spaced from the mounting of the distal end of the said lower arm, and an intermediate control arm extending between the said lower arm and the said first upper arm and pivotally connected to each at points spaced from the ends thereof so as to direct movement of said first upper arm during opening and closing the the stay.

In preferred forms of the stay of the invention, that are conveniently manufactured and sold for fitting subsequently to a window, the stay includes a frame mounting member and a sash mounting member. The proximal ends of the lower and the first upper arms are pivotally connected to the frame mounting member and the distal ends of the lower and the second upper arms are pivotally connected to the sash mounting member. The frame and sash mounting members are adapted to be secured to the frame and sash of a window respectively. In other forms of stay of the invention however, the stay may comprise part of a preformed window assembly with the arms of the stay being directly pivotally connected to the frame and sash of the window without such frame and sash mounting members.

In the window stay of the invention at least a number and preferably each of the pivotal joints between the arms and window frame or sash and arms to other arms is of a suitable friction pivot joint construction.

Preferably such a friction pivot joint between two components such as two arms, or an arm and a frame or sash mounting member, comprises an aperture in a first of the components, an annular shoulder surrounding and projecting from the periphery of said aperture, an aperture in the second component whereby said second component is located about said shoulder, a bushing of a suitable self-lubricating and wear-resistant material interposed between said shoulder and said component to prevent direct contact therebetween, and a fixing means for fixing the joint and applying friction creating pressure thereto extending through the joint and fixed beneath said shoulder or in the said first aperture.

The stay of my invention is suitable for use in both awning and casement applications. The geometry of the stay is such that it provides for good pull in at the top of the stay during closing. The sash mounting points of the stay may be properly spaced apart giving good sash stability when the sash is open whilst still providing for enlarged angles of opening. The stay possesses a high degree of inherent strength. The stay does not incorporate any moving slides or the like so that it is not prone to clogging with dirt and jamming.

Figure 3:
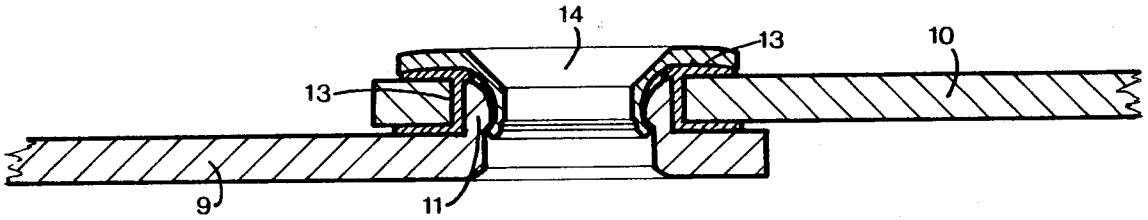

A preferred form of the stay of the invention is illustrated, by way of example, in the accompanying drawings, wherein:

FIG. 1 is a view of the preferred form window stay in its fully extended or open position, FIG. 2 is an end view in the direction of arrow A of the stay in its closed position, and FIG. 3 is a cross-sectional view of a preferred form of friction pivot joint.

The preferred form stay illustrated in FIGS. 1 and 2 is suitably formed from stainless steel. If the stay is formed of stainless steel or a like material the required strength for each of the arms may be achieved with components of lesser dimensions so that the overall bulk of the stay is reduced. The stay comprises a first upper arm 1 and a lower arm 2. The proximal ends of the arms 1 and 2 are adapted to be pivotally connected to the frame of a window, by way of suitable friction pivot joints 4 as will be further described, at points spaced from each other. In the preferred form of stay shown the proximal ends of the arms 1 and 2 are adapted to be connected to the frame via a frame mounting member in the form of a plate 3. The distal end of the lower arm 2 is adapted to be pivotally connected to the sash of the window by way of a similar friction pivot joint 4, in the preferred form via a sash mounting member in the form of a plate 5. The distal end of the first upper arm 1 is pivotally connected to the proximal end of a second upper arm 6, termed a compensating arm, by a further friction pivot joint 4. The other end of the second upper or compensating arm 6 is adapted to be pivotally connected to the sash of the window, in the preferred form via the sash plate 5, at a point spaced from the connection of the lower arm 2 and by way of a friction pivot joint 4 as shown. An intermediate arm 7, termed a control arm, extends between the lower arm 2 and the first upper arm 1. It is pivotally connected to each at points spaced from the ends thereof, by friction pivot joints 4 as shown. In FIG. 2 like reference numerals indicate like components.

Each of the frame and sash plates 3 and 5 is provided with mounting holes 8 whereby the stay may be mounted to a window frame and sash in use. When the bearings 4 employed are of the preferred form type described herein the frame and sash plates 3 and 5 can additionally or alternatively be secured to the frame and sash by screws or like fasteners passing through the bearings themselves. This is advantageous, particularly in casement window applications, as the frame plate is secured to the frame at the same point that loads are applied so that deformation of the frame plate is minimized.

In use the stay can be moved from its fully extended or open position, shown in FIG. 1 in hard outline, wherein the sash bar 5 and a sash mounted thereto extends substantially perpendicularly to the window aperture, to or towards its closed position (or vice versa) by pulling on handles suitably mounted to the window sash as is known in the art. The stay in almost its closed position is shown in phantom outline in FIG. 1, and the movement of the control arm/first upper arm, control arm/lower arm, and sash plate/lower arm pivot joints is as indicated by broken lines. During opening and closing movement the control or intermediate connecting arm 7 will in use tend to direct the movement of the first upper arm 1 giving correct general operation of the stay and in addition ensuring that as the stay is closed the top of the stay is properly moved to its fully closed position so that good pull in is provided. As the stay is closed the control arm 7 will tend to push the first upper arm 1 upwards.

Initially in movement of the stay from its fully open to its closed position, pulling on a sash mounted to the stay will cause the sash mounting plate to pivot in the direction of arrow B in FIG. 1, about the pivot joint 4 at the distal end of the lower arm 2, and the second and first upper arms 6 and 1 to be drawn upwardly. Subsequently further movement of the sash/sash mounting member will cause the lower arm 2 to pivot inwardly about its proximal end towards the frame mounting member 3 and the control arm 7 to move in a similar fashion, pivoting about its lower end pivot joint, in a combined opening scissor action, until both lie parallel and adjacent the frame mounting member when the stay is fully closed. In opening of the stay the above movement is reversed.

As will be appreciated, the stay of the invention does not comprise externally moving parts such as sliding pivots or the like. In addition the sash mounting points of the arms of the stay are properly spaced apart so that the stay stably mounts a window sash. Nonetheless the stay provides for substantially full ninety degree opening of the window sash. The stay provides a 'lifting out' of the window sash type operation similar to that of the patent No. 144922/146130/146886 stay, so that the sealing strip extending about the window aperture is not tended to be dislodged, and enabling full cleaning access. The stay provides good 'pull in' during final closing.

A preferred form of friction pivot joint is shown in FIG. 3. A first component such as a frame or sash plate or first arm is indicated at 9. A second component is indicated at 10. An annular shoulder 11 is formed on the component 9 it surrounds and projects from the periphery of an aperture therein as shown. The component 10 comprises an aperture whereby the component 10 is located about the shoulder 11. A bushing 13 shaped as shown and formed of a suitable self-lubricating and wear resistant material such as nylon or the like is interposed therebetween so that there is no metal to metal contact between the components 9 and 10. A fixing means or button 14 extends through the joint is fixed beneath the shoulder 11 to fix the joint and apply friction creating pressure thereto so that a friction pivot is provided.

The body portion **14*b* of the button preferably comprises an enlarged lower peripheral arm part 14*c* which is engaged beneath the shoulder 11**.

The button comprises top portion **14*a* extending generally radially and of a peripheral flange like formation which extends over the second component 10 via the bushing 13 as shown, and a body portion 14*b* of a generally cylindrical formation which extends through the joint and the shoulder or displacement and which is engaged beneath the shoulder 11 by crimping or the like from the position shown in FIG. 1 to that shown in FIG. 2. The body portion 14*b* of the button preferably comprises an enlarged lower peripheral rim part 14*c* which is engaged beneath the shoulder 11. The engagement of the button 5 into the joint and crimping of the rim portion 5*c*** thereof is so effected as to cause friction creating pressure to be applied to the joint to the extent desired.

It is preferred but not essential that this form of friction pivot joint be employed as such joints can be formed without difficulty from stainless steel enabling the entire stay to be formed of reduced thickness components whilst still possessing the required strength, and thus weight savings to be achieved and enabling a six bar stay of the invention to be provided that can still be accommodated within a standard thirteen millimetre window frame stay cavity. Another advantage of the preferred pivot joint type is that when used it enables the stay components to be pressed together with all of the pivot joints of the stay being fixed, in a single pressing operation. This is an important advantage from a manufacturing point of view. Another advantage of the preferred form pivot joints is that because they include a central aperture the joints in the frame and sash mounting plates can be 'screwed through' with mounting screws, as well as the mounting holes 8. The stay is then secured to the frame and sash of the window at the same point that loads are applied by the stay arms, particularly in casement applications, so that distortion of the frame and sash mounting plates is minimised.

The foregoing describes my invention including a preferred form thereof. Alterations and modifications as will be obvious to those skilled in the art are intended to be incorporated within the scope hereof, as defined in the following claims.

I claim:

1. An enlarged opening angle window stay for use in mounting a window sash to a window frame, comprising a lower arm adapted to be pivotally mounted to the frame of a window at its proximal end and to the sash of the window at its distal end, a first upper arm adapted to be pivotally and fixedly mounted at its proximal end to the frame of the window at a point spaced from the mounting of the proximal end of the said lower arm, a second upper arm pivotally connected at its proximal end to the distal end of the said first upper arm and adapted to be pivotally mounted at its distal end to the said window sash at a point spaced from the mounting of the distal end of the said lower arm, and an intermediate control arm extending between the said lower arm and the said first upper arm and pivotally connected to said lower arm and said first upper arm at a point spaced from the ends thereof and arranged to direct pivotal movement of said first upper arm during opening and closing of the stay.

2. A window stay as claimed in claim 1, wherein the said intermediate control arm is pivotally connected to the said lower arm at a point generally intermediate of the length thereof.

3. A window stay as claimed in claim 2, wherein the said intermediate control arm is pivotally connected to the said first upper arm at a point spaced further from the said distal end thereof than from the said proximal end.

4. A window stay as claimed in claim 3, wherein the said intermediate connecting arm is connected to the said first upper arm at a point that is laterally spaced from the longitudinal axis of the said first upper arm towards said lower arm.

5. A window stay as claimed in claim 4, wherein the length of the said lower arm is greater than the combined lengths of the said first and second upper arms.

6. A window stay as claimed in claim 5, wherein the length of the said first upper arm is greater than the length of the said second upper arm.

7. A window stay as claimed in claim 6, including a frame mounting member and a sash mounting member, the proximal ends of the said lower and the said first upper arms being pivotally connected to the said frame mounting member and the distal ends of the said lower and the said second upper arms being pivotally connected to the said sash mounting member, the said frame and sash mounting members being adapted to be secured to the frame and sash of a window respectively.

8. A window stay as claimed in claim 7, wherein the distance between the mounting points of the said lower and first upper arms on the said frame mounting member is greater than the distance between the mounting points of the said lower and second upper arms on the said sash mounting member.

9. A window stay as claimed in claim 1, wherein a number of the said pivotal connections and pivotal mountings comprise a friction pivot joint.

10. A window stay as claimed in claim 9, wherein each of said friction pivot joints between two components such as two arms or an arm and a frame or sash mounting member comprises an aperture in a first of the components, an annular shoulder surrounding and projecting from the periphery of said aperture, an aperture in the second of the second components whereby said second component is located about said shoulder, a bushing of a suitable self-lubricating and wear-resistant material interposed between said shoulder and said second component to prevent direct contact therebetween and a fixing means for fixing the joint and applying friction creating pressure thereto extending through the joint and fixed beneath said shoulder or in said first aperture.

11. A window stay as claimed in claim 10, wherein the said fixing means for the joint comprises a body portion engaged beneath said shoulder or in said aperture and a top portion extending over said arm about said second aperture.

12. A window stay as claimed in claim 11, wherein said body portion is of a generally cylindrical formation and said top portion is of a generally peripheral flange like formation.

13. A window stay as claimed in claim 12, wherein said bushing extends between said first component and said second component, the internal surface of said second aperture and said shoulder, and said second component and said fixing means top portion.

14. A window stay as claimed in claim 13, wherein said pivot joints comprise a central axial aperture whereby a stay securing fastener may extend through same.

15. An enlarged opening angle window stay for use in mounting a window sash to a window frame, comprising:

a lower arm adapted to be pivotally mounted to the frame of a window at its proximal end and to the sash of the window at its distal end;

a first upper arm adapted to be pivotally mounted at its proximal end to the frame of the window at a point spaced from the mounting of the proximal end of said lower arm;

a second upper arm pivotally connected at its proximal end to the distal end of said first upper arm and adapted to be pivotally mounted at its distal end to said window sash at a point spaced from the mounting of the distal end of said lower arm; and an intermediate control arm extending between said lower arm and said first upper arm and pivotally connected to said lower arm and said first upper arm at a point spaced from the ends thereof and arranged to direct movement of said first upper arm during opening and closing of the stay, said intermediate control arm being pivotally connected to said lower arm at a point generally intermediate of the length thereof, said intermediate control arm being pivotally connected to said first upper arm at a point spaced further from said distal end thereof than from said proximal end; and said intermediate connecting arm being connected to said first upper arm at a point that is laterally spaced from the longitudinal axis of said first upper arm towards said lower arm.

16. A window stay as claimed in claim 15, wherein the length of said lower arm is greater than the combined lengths of said first and second upper arms.

17. A window stay as claimed in claim 16, wherein the length of said first upper arm is greater than the length of said second upper arm.

18. A window stay as claimed in claim 17, including a frame mounting member and a sash mounting member, the proximal ends of said lower and said first upper arms being pivotally connected to said frame mounting member and the distal ends of said lower and said second upper arms being pivotally connected to said sah mounting member, said frame and said sash mounting members being adapted to be secured to the frame and sash of a window respectively.

19. A window stay as claimed in claim 18, wherein the distance between the mounting points of said lower and said first upper arms on said frame mounting member is greater than the distance between the mounting points of said lower and said second upper arms on said sash mounting member.

20. A window stay as claimed in claim 15, wherein a number of said pivotal connections and pivotal mountings comprise a friction pivot joint; each of said friction pivot joints between two components such as two arms or an arm and a frame or sash mounting member comprises an aperture in a first of the components, an annular shoulder surrounding and projecting from the periphery of said aperture, and aperture in the second of the second components whereby said second component is located about said shoulder, a bushing of a suitable self-lubricating and wear-resistant material interposed between said shoulder and said second component to prevent direct contact therebetween and a fixing means for fixing the joint and applying friction creating pressure thereto extending through the joint and fixed beneath said shoulder or in said first aperture.

* * * * *